United States Patent [19]

Kawamura

[11] 4,005,977

[45] Feb. 1, 1977

[54] GAS CIRCULATING COMBUSTION MEANS

[75] Inventor: Yoshio Kawamura, Kawaguchi, Japan

[73] Assignee: Agency of Industrial Science & Technology, Tokyo, Japan

[22] Filed: Jan. 6, 1976

[21] Appl. No.: 646,892

[30] Foreign Application Priority Data

Jan. 13, 1975 Japan ..... 50-6159

[52] U.S. Cl. ..... 431/116; 431/9

[51] Int. Cl.[2] ..... F23M 3/14

[58] Field of Search ..... 431/115, 116, 8, 9; 110/49 R; 126/79; 60/39.65

[56] References Cited

UNITED STATES PATENTS

| | | | |
|---|---|---|---|
| 3,174,526 | 3/1965 | Von Linde | 431/116 |
| 3,851,467 | 12/1974 | Sherman et al. | 60/39.65 |
| 3,852,021 | 12/1974 | Quinn | 431/116 |
| 3,869,244 | 3/1975 | Von Linde et al. | 431/116 |

*Primary Examiner*—Edward G. Favors

*Attorney, Agent, or Firm*—Oblon, Fisher, Spivak, McClelland & Maier

[57] ABSTRACT

A combustion means in which, when the combustion is effected, a flame is stably formed at a small distance from a fuel discharge nozzle is disclosed, which combustion means comprises an outer cylinder, an inner cylinder and an air feed cylinder and is characterized by the fact that a fuel discharge nozzle is disposed at the bottom of said outer cylinder, a path for gas circulation is constituted by the space intervening between said inner cylinder and outer cylinder, and air discharge opening from said air feed cylinder and a combustion gas suction inlet serving to establish communication between said inner cylinder and gas circulation path are disposed at one end of said gas circulation path, and a reflux opening serving to admit the gas from said gas circulation path into the inner cylinder is disposed at the other end of the gas circulation path.

1 Claim, 1 Drawing Figure

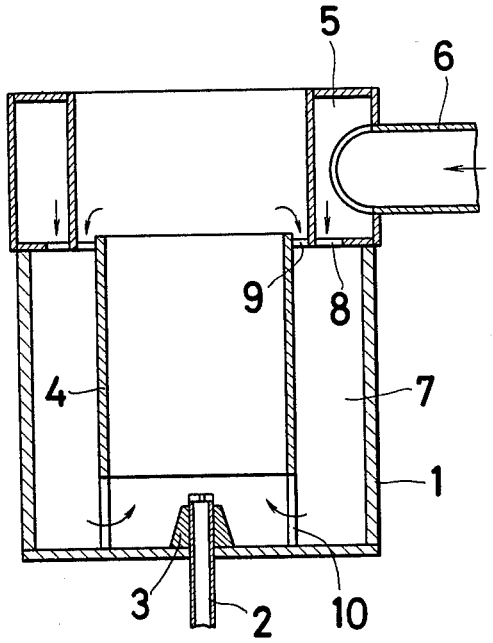
5
6
9
8
4
7
1
3
2
10

GAS CIRCULATING COMBUSTION MEANS

BACKGROUND OF THE INVENTION

This invention relates to a circulation type combustion means adapted to permit circulation of combustion gas.

Generally, means for combustion requires a flame-retaining device capable of stabilizing the flame. Most flame-retaining mechanisms are so devised as to provide desired stability of combustion flame by causing a backflow region of combustion gas to be formed close to the fuel discharge nozzle.

Of the flame-retaining devices which find general acceptance, those which enjoy satisfactory performance of flame-retaining mechanisms have the flame formed in the neighborhood of the fuel discharge nozzle. Since the neighborhood of the fuel discharge nozzle is consequently susceptible to superheating, such flame-retaining devices inevitably entail various attendant drawbacks. In the case of the flame-retaining devices adapted to have the flame formed at an appropriate distance from the fuel discharge nozzle, a region capable of forming a flame occurs in the space between the fuel discharge nozzle and the zone of flame. These devices, therefore, suffer from a disadvantage that said flame zone is not stabilized and tends to produce a phenomenon of vibrated combustion.

An object of the present invention is to provide a gas combustion means which precludes the possibility of exposing the neighborhood of the fuel discharge nozzle to superheating and which produces a stable flame at a fixed distance from the fuel discharge nozzle without entailing the phenomenon of vibrated combustion.

SUMMARY OF THE INVENTION

The present invention provides a combustion means developed for the purpose of attaining the object described above. Said means comprises an outer cylinder having one end thereof closed to serve as the bottom and the other end thereof left open, an inner cylinder disposed inside said outer cylinder and an air feed cylinder, said inner cylinder and outer cylinder being constructed in such a relative position that the space intervening therebetween will constitute a path for gas circulation. This combustion means is provided at the bottom of said outer cylinder with a fuel discharge nozzle pointed in the direction of the inner cylinder, in the air feed cylinder with an air discharge opening disposed in the direction of the circulation path, between the air feed cylinder and the inner cylinder with a suction inlet for combustion gas and between the inner cylinder and the bottom of the outer cylinder with a reflux inlet adapted to admit the gas from said circulation path into the inner cylinder.

In the combustion means of such a construction as described above, when the combustion is effected, the flame is formed at a small distance from the fuel discharge nozzle and, at the same time, a stable reflux region of gas is formed where said flame is formed, with the result that the flame is stabilized because no reverse fire occurs between the fuel discharge nozzle and the zone of flame.

BRIEF EXPLANATION OF THE DRAWING

The drawing is a longitudinal cross section illustrating one preferred embodiment of the typical construction of the means according to the present invention.

DETAILED DESCRIPTION OF THE INVENTION

The drawing is a diagram illustrating one preferred embodiment of the typical construction of the combustion means according to the present invention. In the diagram, 1 denotes an outer cylinder having one end thereof closed to serve as the bottom. In the bottom is disposed a fuel discharge nozzle 2 which is fixed in position with an annular fixture 3 and adapted to discharge the fuel into the interior of the outer cylinder. Inside the outer cylinder, an inner cylinder 4 is disposed in the direction of the discharge of fuel, that is, on the downstream side of the fuel discharge nozzle. Further downstream of the inner cylinder 4 around the downstream portion of said inner cylinder, there is provided an air feed cylinder 5. This air feed cylinder is provided with an air feed pipe 6 for supplying air inwardly from outside. The space enclosed with the inner cylinder 4, the outer cylinder 1 and the closed bottom of said outer cylinder serves as a path 7 for gas circulation. Said air feed cylinder 5 is located at the end opposite said closed bottom forming a part of the enclosure of said gas circulation path. This air feed cylinder 5 is provided with an air discharge opening 8 adapted to discharge air in the direction of the gas circulation path. A suction opening 9 adapted to permit suction of the combustion gas into the gas circulation path is disposed between the downstream side of the inner cylinder 4 relative to the direction of fuel discharge and the air feed cylinder 5.

As the air is discharged through the air discharge opening 8 into the gas circulation path, the resultant current of discharged air causes a part of the combustion gas existing on the downstream side of the inner cylinder 4 to be withdrawn via said suction opening into the gas circulation path.

Further, the inner cylinder 4 is provided at one end thereof closer to the bottom of the outer cylinder with a reflux opening 10 adapted to admit the gas from the gas circulation path into the inner cylinder.

To be specific, the gas circulating combustion means of the present invention comprises an outer cylinder having one end thereof closed to serve as the bottom and the other end thereof left open, an inner cylinder disposed inside said outer cylinder and an air feed cylinder and said combustion means is so constructed that a fuel discharge nozzle pointed in the direction of the interior of the outer cylinder is disposed at the bottom of the outer cylinder, a path for gas circulation is constituted by the inner cylinder, the outer cylinder and the bottom of said outer cylinder, said air feed cylinder disposed at the end of the outer cylinder opposite the bottom of the outer cylinder forming a part of the enclosure of said gas circulation path is provided with an air discharge opening for discharging air in the direction of the gas circulation path, a combustion gas suction inlet is disposed next to said air discharge opening between the air feed cylinder and the inner cylinder so that when the air is discharged via the air discharge opening into the gas circulation path, the resultant current of discharged air causes a part of the combustion gas existing in the inner cylinder to be withdrawn into the circulation path, and a reflux inlet adapted to admit the gas from the gas circulation path into the inner cylinder is disposed between one end of the inner cylinder and the bottom of the outer cylinder.

There is no particular necessity for fixing the shapes of the air discharge opening 8, the suction inlet 9 and the reflux inlet 10. They may be formed with an uninterruptedly annular opening or with a multiplicity of perforations.

As described above, the air discharged via the air discharge opening 8 causes suction of the combustion gas through the suction inlet 9. Subsequently, the air which has entrained the combustion gas enters the inner cylinder via the reflux inlet 10. For this reason, the gas circulation path 7 and the reflux inlet 10 are required each to have a cross section sufficiently greater than that of the suction inlet 9. If the cross section of the air discharge opening 8 is decreased, the speed of air discharge is increased and the volume of the combustion gas to be entrained by the discharge air is accordingly increased, making it necessary to increase the pressure of feed air and heighten the power for air blowing.

Desirably the inner cylinder 4 may be given an inside diameter such that the fuel discharged through the fuel discharge nozzle 2 will come into contact with the inner wall surface of the inner cylinder at the outlet side thereof.

The side of the air feed cylinder 5 exposed to the flame and the neighborhood of the outlet side of the inner cylinder 4 are required to be of a structure resistant to flame and heat, because they are heated to high temperatures.

In the combustion means of the present invention, the fuel is discharged through the fuel discharge nozzle 2 and at the same time the air is discharged through the discharge opening 8 of the air feed cylinder 5, whereby a part of the combustion gas existing on the downstream side of the inner cylinder 4 is withdrawn into the gas circulation path 7 by virtue of the current of air from the air discharge opening 8 and, while being mixed with the air, advanced through the gas circulation path 7 in the direction of the upstream side and subsequently through the reflux inlet 10 into the interior of the inner cylinder 4. Inside the inner cylinder, the gas-air mixture is advanced in the direction of the downstream side while being mixed with the fuel discharged through the fuel discharge nozzle 2.

Consequently, a backflow zone of combustion gas is formed between the downstream side of the inner cylinder 4 and the air feed cylinder 5, allowing the flame to be formed in the neighborhood of said backflow zone. In spite of the presence of the inflammable gas, said backflow zone has no possibility of reversely spreading the flame because the mixed gas is flowing uniformly at a high speed inside the inner cylinder 4.

In the combustion means of the present invention, the flame is stably formed on the downstream side of the inner cylinder apart from the fuel discharge nozzle as described above and no flame is formed around the fuel discharge nozzle.

Thus, the fuel discharge nozzle can be prevented from superheating because it is not exposed to contact with the high-temperature gas and also because the possible temperature elevation of this nozzle by the radiant heat from the high-temperature gas is limited. Since this combustion means involves circulation of the combustion gas, the combustion is effected by use of air diluted with the circulating combustion gas which is an inert gas, with the result that the combustion proceeds mildly and may contribute to lessening otherwise possible pollution causable in the case of vigorous combustion.

The combustion means of the present invention is advantageous for use with a gaseous fuel or liquid fuel. Particularly in the case of a liquid fuel, the heating effected by means of the mixed gas formed of air and combustion gas accelerates the vaporization of the sprayed fuel and, consequently, brings about conditions facilitating combustion.

What is claimed is:

1. A gas circulating combustion means comprising an outer cylinder having one end thereof closed to serve as the bottom and the other end left open, an inner cylinder disposed inside said outer cylinder and an air feed cylinder, said combustion means being so constructed that a fuel discharge nozzle pointed in the direction of the interior of the outer cylinder is disposed at the bottom of the outer cylinder, a path for gas circulation is constituted by the inner cylinder, the outer cylinder and the bottom of said outer cylinder, said air feed cylinder is disposed at the end of the outer cylinder opposite the bottom of the outer cylinder to form a part of the enclosure of said gas circulation path and is provided with an air discharge opening for discharging air in the direction of the gas circulation path, a combustion gas suction inlet is disposed next to said air discharge opening between the air feed cylinder and the inner cylinder so that when the air is discharged via the air discharge opening into the gas circulation path, the resultant current of discharged air causes a part of the combustion gas existing in the inner cylinder to be withdrawn into the circulation path, and a reflux inlet adapted to admit the gas circulation path into the inner cylinder is disposed between one end of the inner cylinder and the bottom of the outer cylinder.

* * * * *